US010207900B2

(12) United States Patent
Kitazawa

(10) Patent No.: US 10,207,900 B2
(45) Date of Patent: Feb. 19, 2019

(54) ELEVATOR CAR DOOR APPARATUS

(71) Applicant: MITSUBISHI ELECTRIC CORPORATION, Chiyoda-ku (JP)

(72) Inventor: Masaya Kitazawa, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 157 days.

(21) Appl. No.: 15/329,749

(22) PCT Filed: Oct. 15, 2014

(86) PCT No.: PCT/JP2014/077445
§ 371 (c)(1),
(2) Date: Jan. 27, 2017

(87) PCT Pub. No.: WO2016/059685
PCT Pub. Date: Apr. 21, 2016

(65) Prior Publication Data
US 2017/0217732 A1 Aug. 3, 2017

(51) Int. Cl.
*B66B 13/20* (2006.01)
*B66B 13/08* (2006.01)
(Continued)

(52) U.S. Cl.
CPC ..... *B66B 13/20* (2013.01); *B66B 13/08* (2013.01); *B66B 13/12* (2013.01); *B66B 9/00* (2013.01)

(58) Field of Classification Search
CPC ..... B66B 13/20; B66B 13/08; B66B 13/12
See application file for complete search history.

(56) References Cited

U.S. PATENT DOCUMENTS 3,783,977 A * 1/1974 Voser ..... B66B 13/12 187/319
4,947,964 A * 8/1990 Husmann ..... B66B 13/12 187/314
(Continued)

FOREIGN PATENT DOCUMENTS

CN 10-7353 1/1998
CN 2013-09790 9/2009
(Continued)

OTHER PUBLICATIONS

International Search Report dated Jan. 20, 2015 in PCT/JP2014/077445 Filed Oct. 15, 2014.
(Continued)

*Primary Examiner* — Michael A Riegelman
(74) *Attorney, Agent, or Firm* — Xsensus, LLP

(57) ABSTRACT

In an elevator car door apparatus, a locking member is disposed on a blade-carrying car door, and is displaceable between an unlocked position and a locked position interdependently with movement of a doorstop-side blade. A guiding portion is disposed on the locking member. A guiding cam is disposed outside the blade-carrying car door. When the car is positioned outside an appropriate floor alignment position, the blade-carrying car door moves in an opening direction, the guiding portion moves along the guiding cam, the locking member displaces to the locked position, and the doorstop-side blade also displaces to a locking accommodating position, the locking member catches in a fixed latch, and movement of the blade-carrying car door in the opening direction is prevented.

18 Claims, 8 Drawing Sheets

(51) Int. Cl.
*B66B 13/12* (2006.01)
*B66B 9/00* (2006.01)

(56) References Cited

U.S. PATENT DOCUMENTS 5,246,089 A * 9/1993 Husmann ..... B66B 13/12 187/319
5,894,911 A * 4/1999 Bozorgzadeh ..... B66B 13/185 187/335
6,021,871 A * 2/2000 Grabner ..... B66B 13/12 187/335
7,077,242 B2 * 7/2006 Cocher ..... B66B 13/12 187/330
7,097,002 B2 * 8/2006 Bisang ..... B66B 13/12 187/315
7,681,695 B2 * 3/2010 Christen ..... B66B 13/12 187/319
8,607,937 B2 * 12/2013 Gilli ..... B66B 13/12 187/319
8,820,485 B2 * 9/2014 Umbaugh ..... B66B 13/16 187/317
9,637,350 B2 * 5/2017 Mittermayr ..... B66B 13/12
10,040,669 B2 * 8/2018 Zhang ..... B66B 13/12
2005/0126860 A1 * 6/2005 Rennetaud ..... B66B 13/12 187/319
2005/0139429 A1 * 6/2005 Bisang ..... B66B 13/12 187/319
2006/0107785 A1 * 5/2006 Zappa ..... B66B 13/20 74/612
2007/0295564 A1 * 12/2007 Someya ..... B66B 13/20 187/319
2012/0118676 A1 * 5/2012 Utsunomiya ..... B66B 13/12 187/330
2012/0298453 A1 * 11/2012 Fujii ..... B66B 13/12 187/330
2015/0203329 A1 * 7/2015 Zappa ..... B66B 13/125 187/319
2016/0130116 A1 * 5/2016 Kitazawa ..... B66B 13/12 187/335
2017/0130486 A1 * 5/2017 Zappa ..... B66B 13/06
2017/0217732 A1 * 8/2017 Kitazawa ..... B66B 13/20

FOREIGN PATENT DOCUMENTS

EP 1 860 056 A1 11/2007
EP 2 426 076 A1 3/2012
JP 54-132163 U1 9/1979
JP 59-30638 B2 7/1984
JP 1-162696 A 6/1989
JP 2013-103780 A 5/2013
WO 2006/097997 A1 9/2006
WO 2010/125650 A1 11/2010
WO 2015/008386 A1 1/2015

OTHER PUBLICATIONS

Chinese Office Action dated Aug. 1, 2018 in Chinese Application No. 2018072701800560.

* cited by examiner

ELEVATOR CAR DOOR APPARATUS

TECHNICAL FIELD

The present invention relates to an elevator car door apparatus that has a car door opening preventing function.

BACKGROUND ART

In conventional elevators, a car door locking apparatus that locks a car door is disposed on a car to prevent passengers inside the car from forcing the car doors open and falling into a hoistway if the car has stopped between floors. In conventional car door locking apparatuses, unlocking cams are installed on a landing side so as to unlock mechanically only when the car arrives at positions that have unlocking cams (see Patent Literature 1, for example).

CITATION LIST

Patent Literature

[Patent Literature 1]
Japanese Patent Publication No. 2008-528399 (Gazette)

SUMMARY OF THE INVENTION

Problem to be Solved by the Invention

In conventional car door locking apparatuses such as that described above, it is necessary to install unlocking cams on all floors, increasing manufacturing costs and installation burden if the number of floors is large.

The present invention aims to solve the above problems and an object of the present invention is to provide an elevator car door apparatus that can prevent opening of a car door between floors by a simple configuration.

Means for Solving the Problem

An elevator car door apparatus according to the present invention includes: a blade-carrying car door that opens and closes a car doorway by sliding horizontally; a doorstop-side blade that is disposed on the blade-carrying car door, and that is displaceable horizontally relative to the blade-carrying car door between an unlocking accommodating position, and a locking accommodating position that is closer to a door pocket side than the unlocking accommodating position; a locking member that is disposed on the blade-carrying car door, and that is displaceable between an unlocked position and a locked position interdependently with movement of the doorstop-side blade; a fixed latch that is disposed outside the blade-carrying car door, and that stops movement of the blade-carrying car door in an opening direction by the locking member catching thereon when the locking member is in the locked position; a guiding cam that is disposed on an external portion of the blade-carrying car door; and a guiding portion that is disposed on the locking member, wherein: the doorstop-side blade is constantly subjected to a force toward the locking accommodating position; the locking member is held in the unlocked position, and the doorstop-side blade is also held in the unlocking accommodating position, by the guiding portion contacting the guiding cam when the blade-carrying car door is in a fully closed state; if the blade-carrying car door moves in the opening direction when a car is positioned in an appropriate floor alignment position, a landing engaging portion that is disposed on a landing door makes contact such that displacement of the doorstop-side blade to the locking accommodating position is prevented, and such that displacement of the locking member to the locked position is also prevented; and when the car is positioned outside the appropriate floor alignment position, the blade-carrying car door moves in the opening direction, the guiding portion moves along the guiding cam, the locking member displaces to the locked position, and the doorstop-side blade also displaces to the locking accommodating position, the locking member catches in the fixed latch, and movement of the blade-carrying car door in the opening direction is prevented.

Effects of the Invention

In an elevator car door apparatus according to the present invention, because, when the car is positioned outside an appropriate floor alignment position, the blade-carrying car door moves in the opening direction, the guiding portion moves along the guiding cam, the locking member displaces to the locked position, and the doorstop-side blade also displaces to the locking accommodating position, the locking member catches in the fixed latch, and movement of the blade-carrying car door in the opening direction is prevented, opening of car doors between floors can be prevented by a simple configuration.

DESCRIPTION OF EMBODIMENTS

Preferred embodiments of the present invention will now be explained with reference to the drawings.

Embodiment 1

Figure 1:
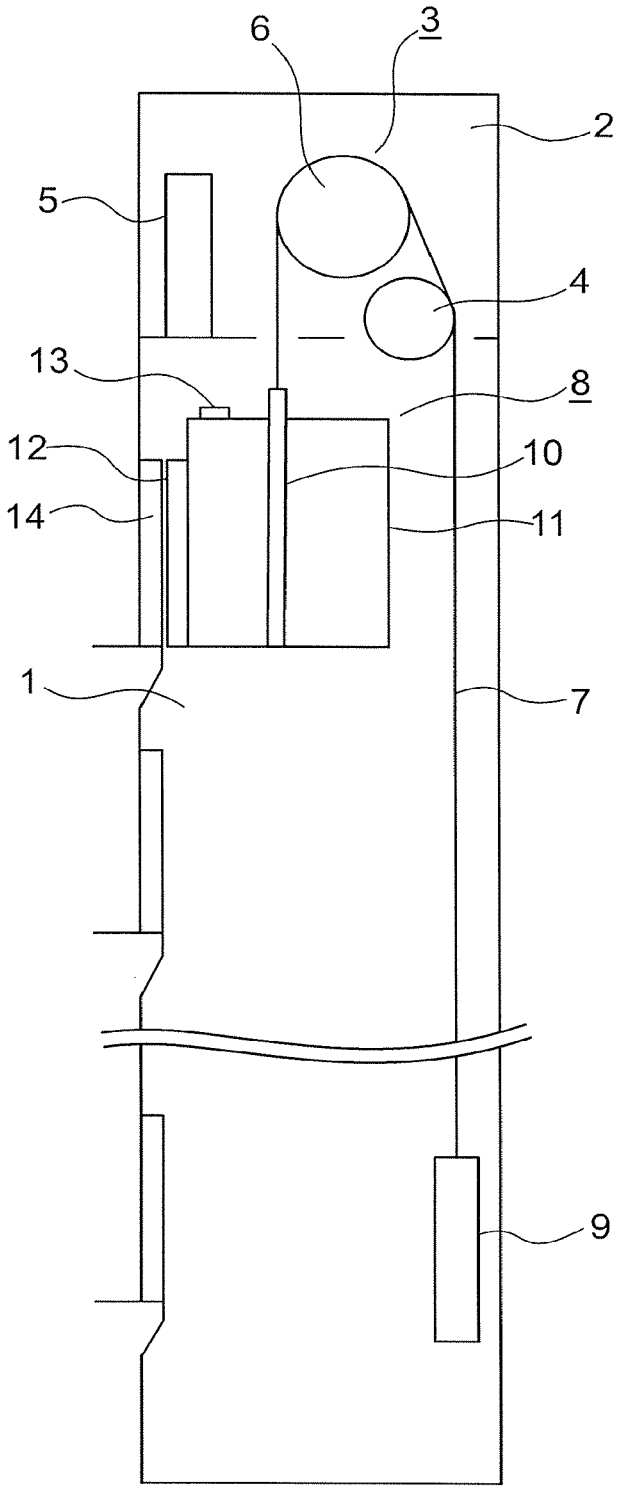
FIG. 1 is a schematic configuration diagram that shows an elevator according to Embodiment 1 of the present invention.

FIG. 1 is a schematic configuration diagram that shows an elevator according to Embodiment 1 of the present invention. In the figure, a machine room 2 is disposed in an upper portion of a hoistway 1. A hoisting machine (a driving apparatus) 3, a deflecting sheave 4, and an elevator controlling apparatus (a controlling board) 5 are installed in the machine room 2. The hoisting machine 3 has: a driving sheave 6; a hoisting machine motor (not shown) that rotates the driving sheave 6; and a hoisting machine brake (not shown) that brakes rotation of the driving sheave 6.

A suspending body 7 is wound onto the driving sheave 6 and the deflecting sheave 4. A plurality of ropes or a plurality of belts are used as the suspending body 7. A car 8 is connected to a first end portion of the suspending body 7. A counterweight 9 is connected to a second end portion of the suspending body 7.

The car 8 and the counterweight 9 are suspended inside the hoistway 1 by the suspending body 7 so as to be raised and lowered inside the hoistway 1 by a driving force from the hoisting machine 3. The elevator controlling apparatus 5 controls operation of the car 8 by controlling the hoisting machine 3.

A pair of car guide rails (not shown) that guide raising and lowering of the car 8 and a pair of counterweight guide rails (not shown) that guide raising and lowering of the counterweight 9 are installed inside the hoistway 1.

The car 8 has: a car frame 10 to which the suspending body 7 is connected; and a cage 11 that is supported by the car frame 10. A pair of car doors 12 that open and close a car doorway by sliding horizontally in opposite directions to each other are disposed on a front surface of the cage 11. A door controller 13 that controls opening and closing operations of the car doors 12 is disposed on the car 8.

Pairs of landing doors 14 that open and close landing doorways by sliding horizontally in opposite directions to each other are respectively disposed on landings of a plurality of floors. The landing doors 14 are operated so as to perform opening and closing operations interdependently with the car doors 12 when the car 8 is at a floor.

Figure 2:
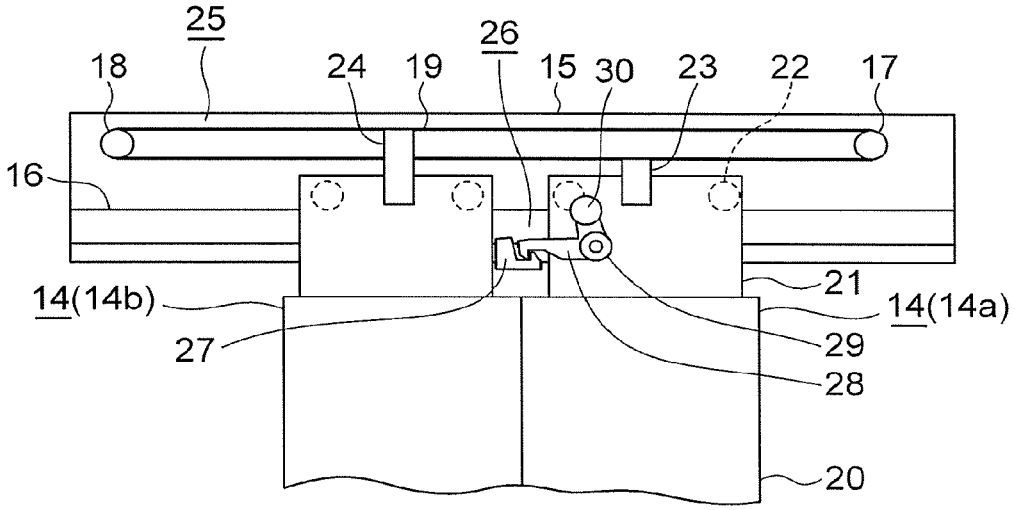
FIG. 2 is a front elevation of landing doors from FIG. 1 when viewed from a hoistway side.

FIG. 2 is a front elevation of landing doors 14 from FIG. 1 when viewed from the hoistway 1 side. A landing door frame 15 is fixed to an upper portion of the landing doorway. A landing door rail 16 that is parallel to a width direction of the landing doorway is disposed on the landing door frame 15.

A first landing door pulley 17 is disposed on a first longitudinal end portion of the landing door frame 15. A second landing door pulley 18 is disposed on a second longitudinal end portion of the landing door frame 15. An endless coupling rope 19 is wound onto the first and second landing door pulleys 17 and 18.

Each of the landing doors 14 has: a landing door panel 20; and a landing door hanger 21 that is fixed to an upper portion of the landing door panel 20. A plurality of landing door rollers 22 that roll while moving along the landing door rail 16 are disposed on each of the landing door hangers 21. Each of the landing doors 14 is suspended by the landing door rail 16, and performs the opening and closing operations parallel to the landing door rail 16.

A first landing door 14*a*, which is one of the landing doors 14, is connected to the coupling rope 19 by means of a first landing door linking fitting 23. A second landing door 14*b*, which is the other of the landing doors 14, is connected to the coupling rope 19 by means of a second landing door linking fitting 24.

When the coupling rope 19 cycles due to the opening and closing operations of the first landing door 14*a*, the second landing door 14*b* moves in an opposite direction to the first landing door 14*a*. The landing door interlocking mechanism 25 includes the landing door pulleys 17 and 18, the coupling rope 19, and the landing door linking fittings 23 and 24, and interlocks the second landing door 14*b* to the opening and closing operations of the first landing door 14*a*.

An interlocking apparatus 26 for preventing the landing doors 14 from being opened from the landing when the car 8 is not at that floor is disposed between the first landing door 14*a* and the landing door frame 15. The interlocking apparatus 26 has: a catch 27; an interlocking latch 28; a fixed interlocking roller 29; and a movable interlocking roller 30. A landing engaging portion according to Embodiment 1 includes the interlocking rollers 29 and 30.

The catch 27 is fixed to the landing door frame 15. The interlocking latch 28 is mounted rotatably to the landing door hanger 21 of the first landing door 14*a*. When the landing doors 14 are in a fully closed state, movement of the landing doors 14 in the opening direction is prevented by a tip end portion of the interlocking latch 28 catching on the catch 27.

The fixed interlocking roller 29 is disposed so as to be coaxial with a rotating shaft of the interlocking clutch 28. The movable interlocking roller 30 is mounted to the interlocking latch 28, and is rotatable together with the interlocking latch 28.

Figure 3:
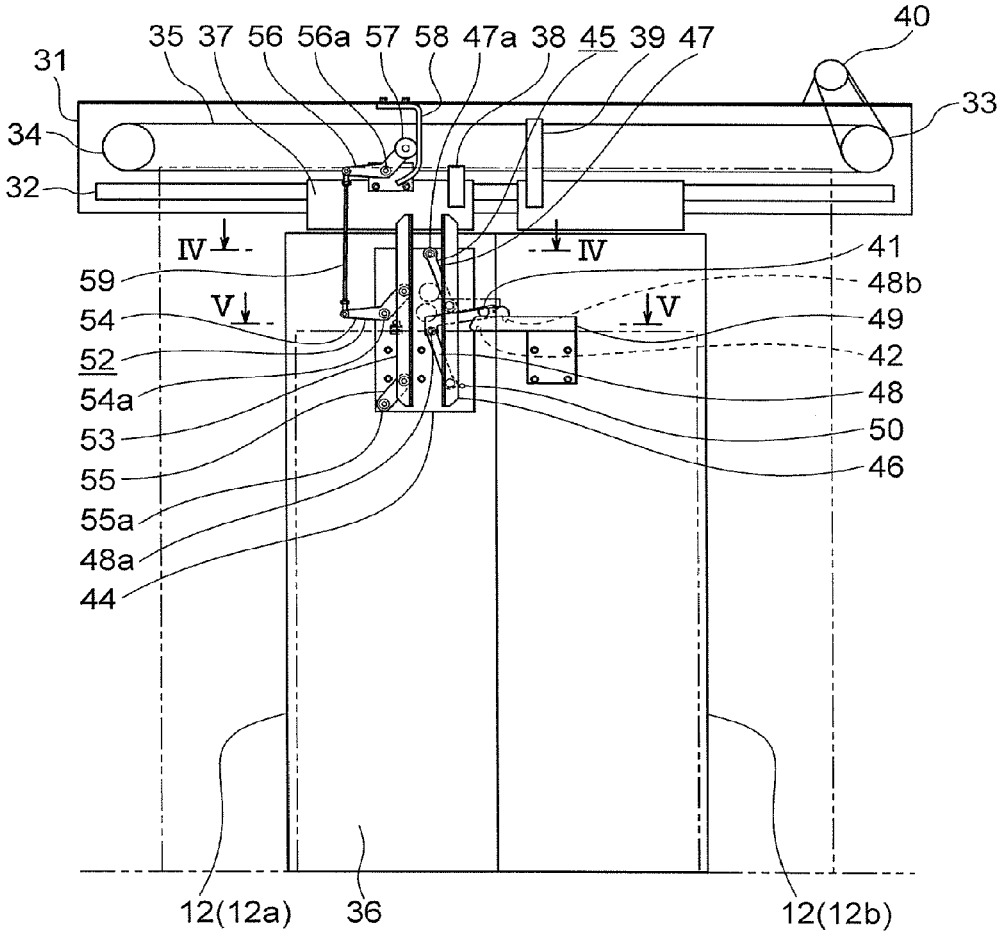
FIG. 3 is a front elevation of car doors from FIG. 1 when viewed from a landing side.

FIG. 3 is a front elevation of car doors 12 from FIG. 1 when viewed from a landing side. A car door frame 31 is fixed to an upper portion of the car doorway. A car door rail 32 that is parallel to a width direction of the car doorway is disposed on the car door frame 31.

A driving pulley 33 is disposed on a first longitudinal end portion of the car door frame 31. A driven pulley 34 is disposed on a second longitudinal end portion of the car door frame 31. An endless car door driving rope 35 is wound onto the driving pulley 33 and the driven pulley 34.

Each of the car doors 12 has: a car door panel 36; and a car door hanger 37 that is fixed to an upper portion of the car door panel 36. Each of the car doors 12 is suspended by the car door rail 32, and performs the opening and closing operations parallel to the car door rail 32.

A first car door 12*a*, which is one of the car doors 12, is connected to the car door driving rope 35 by means of a first car door linking fitting 38. A second car door 12*b*, which is the other of the car doors 12, is connected to the car door driving rope 35 by means of a second car door linking fitting 39.

A door motor 40 is fixed above the car door frame 31. Rotation of the door motor 40 is transmitted to the driving pulley 33. When the driving pulley 33 is rotated by the door motor 40, the car door driving rope 35 cycles and the driven pulley 34 rotates. The first and second car doors 12*a* and 12*b* perform the opening and closing operations thereby.

A supporting plate 44 is fixed to the first car door 12*a*. A doorstop-side blade 46 that has an L-shaped cross section is mounted to the supporting plate 44 by means of a first parallel linking mechanism 45. Specifically, the first car door 12*a* constitutes a blade-carrying car door according to Embodiment 1. The doorstop-side blade 46 is disposed vertically. The first parallel linking mechanism 45 has a rod-shaped first upper portion link 47 and an L-shaped first lower portion link 48.

A first end portion (an upper end portion) of the first upper portion link 47 is mounted to the supporting plate 44 so as to be rotatable around a rotating shaft 47*a*. A second end portion (a lower end portion) of the first upper portion link 47 is rotatably linked to an intermediate portion of the doorstop-side blade 46.

An intermediate portion of the first lower portion link 48 is mounted to the supporting plate 44 so as to be rotatable around a rotating shaft 48*a*. A first end portion of the first lower portion link 48 is rotatably linked to a lower end portion of the doorstop-side blade 46.

A portion of the first lower portion link 48 from the intermediate portion to a second end portion crosses with the doorstop-side blade 46. The second end portion of the first lower portion link 48 thereby protrudes on an opposite side of the doorstop-side blade 46 from the rotating shaft 48*a*.

A hook-shaped locking portion 48*b* is disposed on the second end portion of the first lower portion link 48. A guiding roller 41 is rotatably mounted between the first lower portion link 48 that crosses the doorstop-side blade 46 and the locking portion 48*b*. The first lower portion link 48 is able to displace rotationally between an unlocked position (FIG. 3) and a locked position (FIG. 10) interdependently with the movement of the doorstop-side blade 46.

A fixed latch 42 and a guiding cam 49 are fixed to the second car door 12*b*. Specifically, in Embodiment 1, the fixed latch 42 and the guiding cam 49 are fixed to the second car door 12*b*, which is outside the blade-carrying car door. The second car door 12*b* constitutes a guiding cam-carrying car door according to Embodiment 1.

A horizontal guiding surface is formed on an upper surface of the guiding cam 49. When the car doors 12 are in a fully closed state, the guiding roller 41 is positioned on the guiding surface of the guiding cam 49, and the locking portion 48*b* is positioned in the unlocked position that is shown in FIG. 3.

Figure 10:
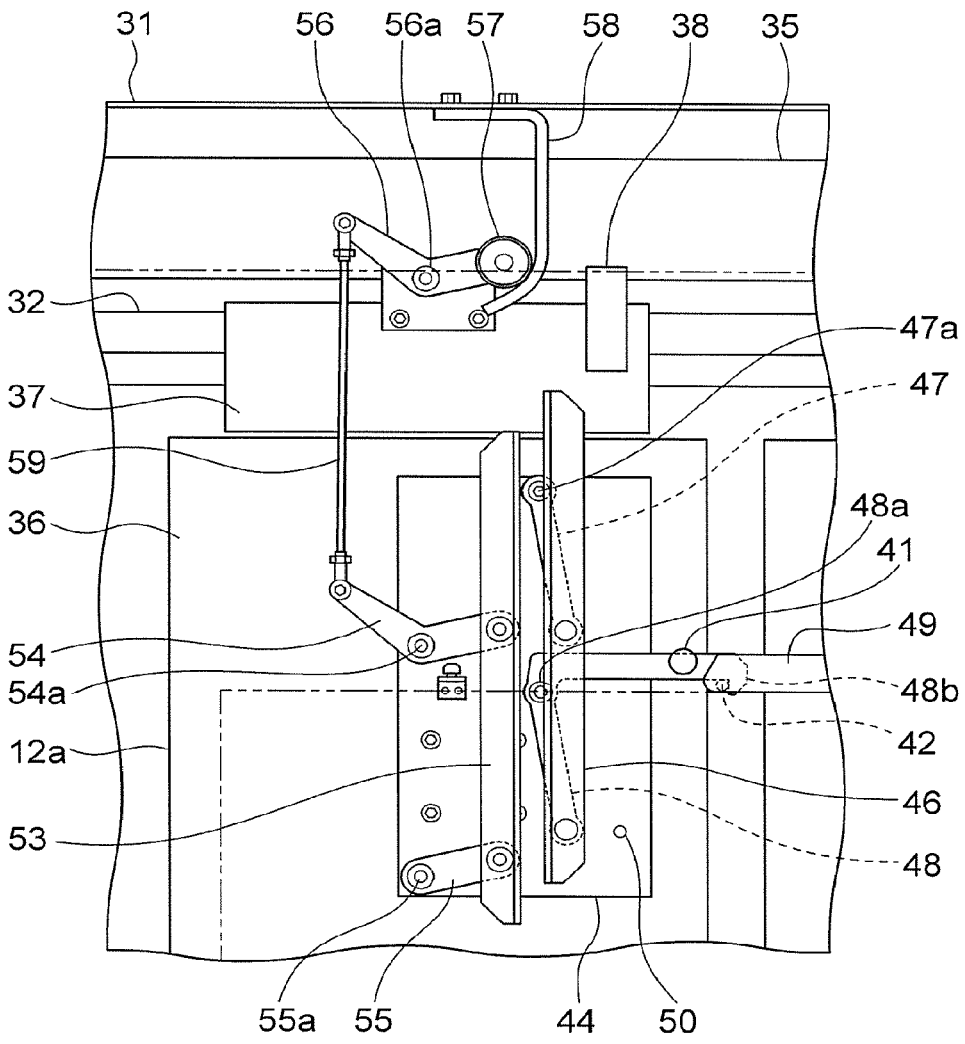
FIG. 10 is a front elevation that shows a state in which an attempt has been made to open the car doors in FIG. 3 outside a door zone.

If an attempt is made to open the car doors 12 without imparting an external force to the link 48, the guiding roller 41 is separated from the guiding cam 49, and the locking portion 48*b* moves to the locked position, as shown in FIG. 10. In this state, the locking portion 48*b* catches on the fixed latch 42, preventing movement of the car doors 12 in the opening direction. In other words, in Embodiment 1, the first lower portion link 48 also serves as a locking member.

The doorstop-side blade 46 is displaceable in a horizontal direction (the opening and closing direction of the car doors 12) relative to the first car door 12*a* by the rotation of the links 47 and 48 between an unlocking accommodating position (FIG. 3), and a locking accommodating position (FIG. 10) that is closer to a door pocket than the unlocking accommodating position.

The doorstop-side blade 46 is constantly subjected to a force toward the door pocket, i.e., toward the locking accommodating position by the action of gravity or a spring force. However, when the car doors 12 are in the fully closed state, the first lower portion link 48 is held in the unlocked position, and the doorstop-side blade 46 is also held toward the doorstop, i.e., toward the unlocking accommodating position by the guiding roller 41 being positioned on the guiding cam 49.

A stopper 50 that limits a range of available movement of the doorstop-side blade 46 toward the doorstop is disposed on the supporting plate 44. The stopper 50 is disposed so as to ensure some clearance from the doorstop-side blade 46 when the car doors 12 are in a fully closed state. Because of that, a slight gap arises between the guiding cam 49 and the guiding roller 41 when the doorstop-side blade 46 is placed in contact with the stopper 50.

A door pocket-side blade 53 that has an L-shaped cross section is mounted to the supporting plate 44 by means of a second parallel linking mechanism 52. The second parallel linking mechanism 52 has a second upper portion link 54 and a second lower portion link 55.

An intermediate portion of the second upper portion link 54 is mounted to the supporting plate 44 so as to be rotatable around a rotating shaft 54*a*. A first end portion of the second upper portion link 54 is rotatably linked to an intermediate portion of the door pocket-side blade 53.

A first end portion of the second lower portion link 55 is mounted to the supporting plate 44 so as to be rotatable around a rotating shaft 55*a*. A second end portion of the second lower portion link 55 is rotatably linked to a lower end portion of the door pocket-side blade 53.

The door pocket-side blade 53 is disposed parallel to the doorstop-side blade 46, i.e., vertically. The door pocket-side blade 53 is displaceable in a horizontal direction (the opening and closing direction of the car doors 12) by the rotation of the links 54 and 55.

A lever 56 that is rotatable around a rotating shaft 56*a* is disposed on an upper portion of the first car door 12*a*. The rotating shaft 56*a* is disposed on an intermediate portion of the lever 56. A lever roller 57 is disposed on a first end portion of the lever 56. A guiding member 58 that the lever roller 57 contacts when the first car door 12*a* is in the closed position is fixed to the car door frame 31.

A linking rod 59 is linked between a second end portion of the lever 56 and a second end portion of the second upper portion link 54. The door pocket-side blade 53 is constantly pressed toward a doorstop side by the action of gravity or a spring force.

When the first car door 12*a* is in the closed position, the lever roller 57 is in contact with the guiding member 58, and the door pocket-side blade 53 is separated from the interlocking rollers 29 and 30.

In contrast to that, when the first car door 12*a* moves in the opening direction, the lever 56 rotates clockwise in FIG. 3, and the door pocket-side blade 53 also displaces toward the doorstop-side blade 46, reducing spacing between the blades 46 and 53, and the interlocking rollers 29 and 30 are gripped between the blades 46 and 53.

Moreover, a configuration that makes the door pocket-side blade 53 displaceable horizontally is not required, and the door pocket-side blade 53 may alternatively be fixed to the car doors 12.

Figure 4:
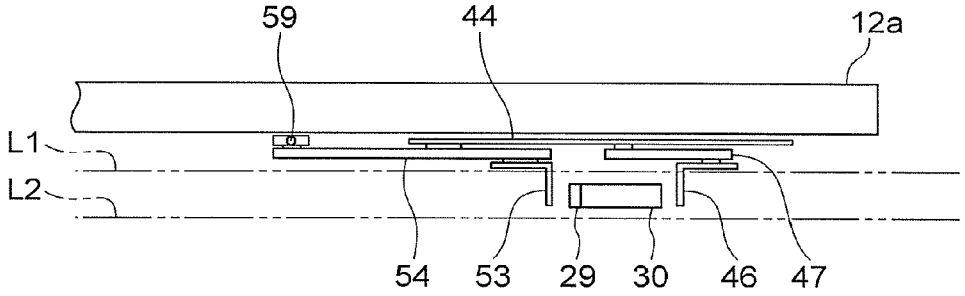
FIG. 4 is a cross section that is taken along Line IV-IV in FIG. 3.
Figure 5:
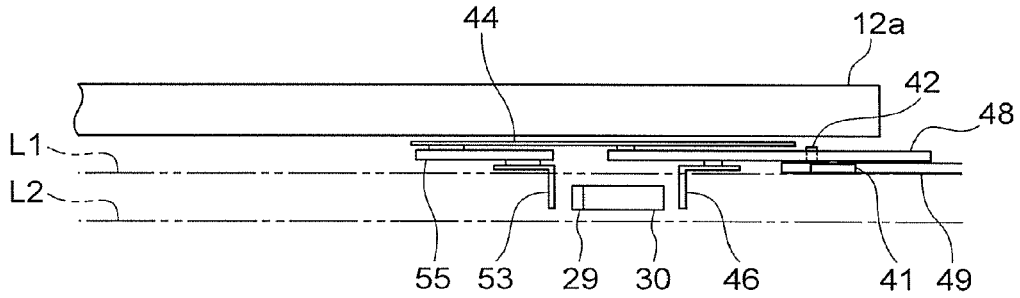
FIG. 5 is a cross section that is taken along Line V-V in FIG. 3.

FIG. 4 is a cross section that is taken along Line IV-IV in FIG. 3, and FIG. 5 is a cross section that is taken along Line V-V in FIG. 3. When the car 8 is at a floor, the doorstop-side blade 46 is disposed closer to the doorstop side than the interlocking rollers 29 and 30, and the door pocket-side blade 53 is disposed closer to the door pocket side than the interlocking rollers 29 and 30.

The interlocking rollers 29 and 30 are disposed between a car doorsill line (a landing-side end surface of the car doorsill) L1 and a landing doorsill line (a car-side end surface of the landing doorsill) L2 when viewed from directly above. In addition, the links 47, 48, 54, and 55, the linking portions between the links 47 and 48 of the doorstop-side blade 46, and the linking portions between the links 54 and 55 of the door pocket-side blade 53 are disposed inside (on the car 8 side of) the car doorsill line L1 when viewed from directly above.

Using a configuration of this kind, if the first car door 12*a* is moved in the opening direction when the car 8 is positioned at an appropriate floor alignment position, the interlocking rollers 29 and 30 contact each other, preventing displacement of the doorstop-side blade 46 toward the locking accommodating position, and also preventing displacement of the first lower portion link 48 toward the locked position.

When the car 8 is positioned outside an appropriate floor alignment position, the first car door 12*a* move in the opening direction, the guiding roller 41 moves parallel to the guiding cam 49, the guiding roller 41 separates from the guiding cam 49, and the first lower portion link 48 displaces to the locked position, and the doorstop-side blade 46 also displaces to the locking accommodating position, and the locking portion 48*b* catches on the fixed latch 42, preventing movement of the first car door 12*a* in the opening direction.

Next, operation will be explained. When the car doors 12 are in the fully closed position, the guiding roller 41 that is fixed to the link 48 contacts the guiding cam 49, as shown in FIGS. 3 and 5. The locking portion 48*b* and the doorstop-side blade 46 are positioned on an unlocked side. In addition, the doorstop-side blade 46 and the door pocket-side blade 53 are separated from the interlocking rollers 29 and 30.

Figure 6:
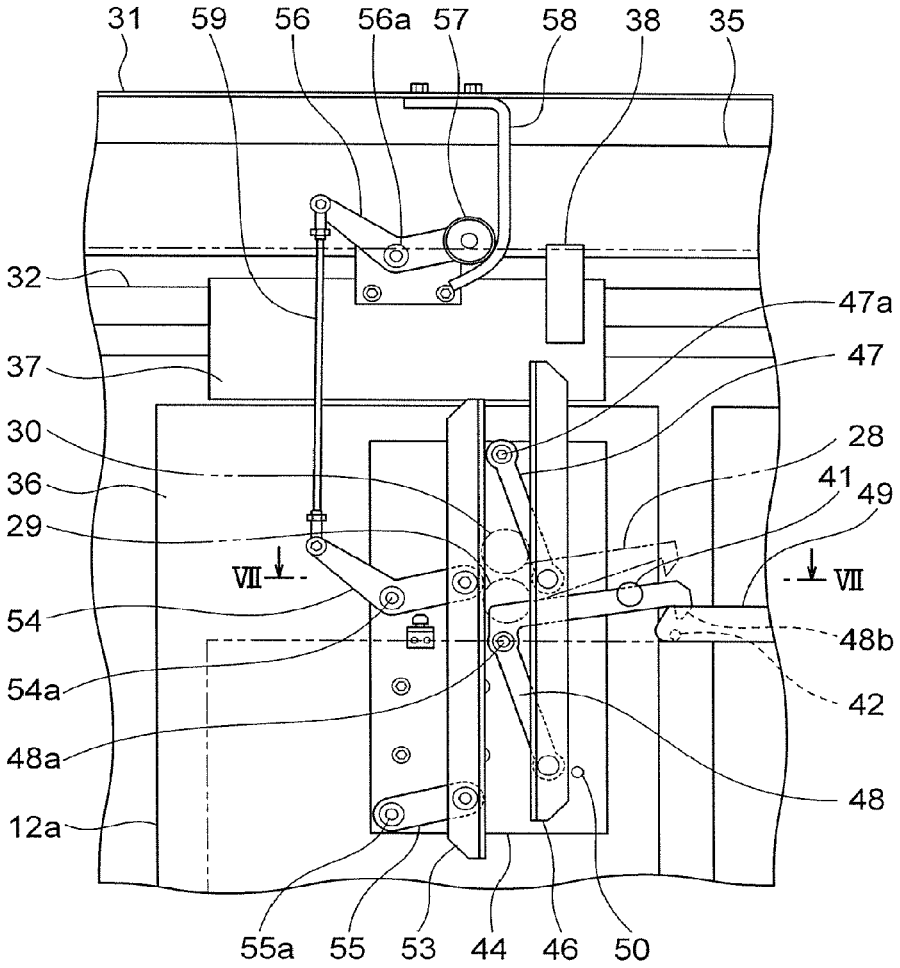
FIG. 6 is a front elevation that shows a state in which the car doors in FIG. 3 have moved slightly in an opening direction.
Figure 7:
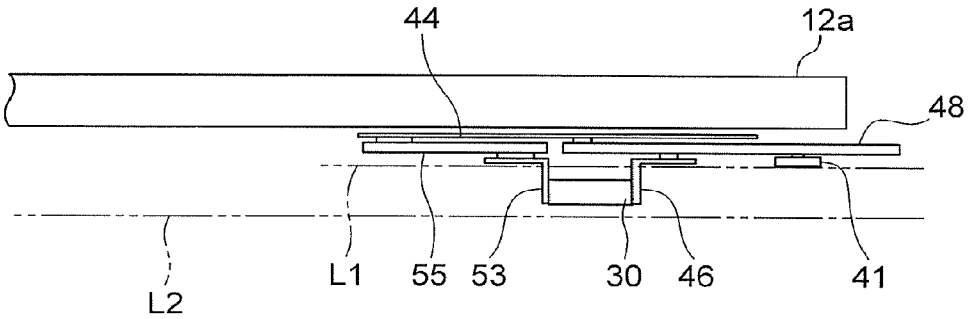
FIG. 7 is a cross section that is taken along Line VII-VII in FIG. 6.

FIG. 6 is a front elevation that shows a state in which the car doors 12 in FIG. 3 have moved slightly in an opening direction, and FIG. 7 is a cross section that is taken along Line VII-VII in FIG. 6. When the car doors 12 begin to move in the opening direction and the guiding roller 41 moves to the end portion of the guiding cam 49, the first link 48 rotates clockwise and the doorstop-side blade 46 starts to move in the door pocket direction. However, a roller contacting surface of the doorstop-side blade 46 (a surface that is perpendicular to the front surface of the first car door 12*a*) contacts the interlocking rollers 29 and 30, preventing movement of the doorstop-side blade 46 in the door pocket direction. Thus, the locking portion 48*b* of the first lower portion link 48 will not move to the locked position. The interlocking latch 28 is rotated, also placing the interlocking apparatus 26 of the landing doors 14 in the unlocked state.

Figure 8:
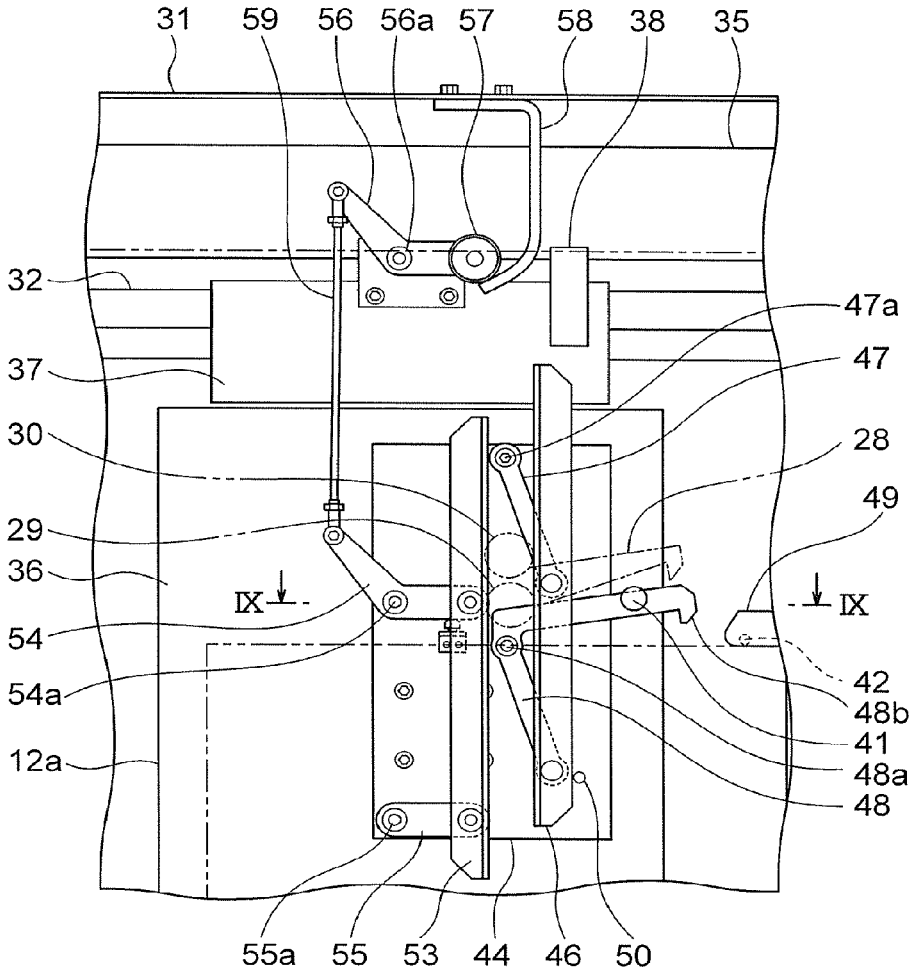
FIG. 8 is a front elevation that shows a state in which the car doors in FIG. 6 have moved further in the opening direction.
Figure 9:
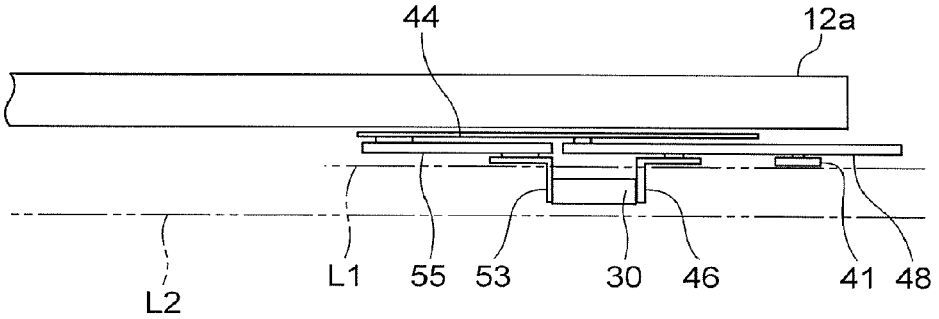
FIG. 9 is a cross section that is taken along Line IX-IX in FIG. 8.

FIG. 8 is a front elevation that shows a state in which the car doors 12 in FIG. 6 have moved further in the opening direction, and FIG. 9 is a cross section that is taken along Line IX-IX in FIG. 8. When the car doors 12 move further in the opening direction, the door pocket-side blade 53 moves in a doorstop direction relative to the first car door 12*a*, and the doorstop-side blade 46 is moved in the doorstop direction by means of the interlocking rollers 29 and 30. The doorstop-side blade 46 thereby contacts the stopper 50.

The first lower portion link 48 rotates counterclockwise in FIG. 8, such that the locking portion 48*b* is positioned in a position that is further separated from the locked position. The interlocking rollers 29 and 30 are gripped between the blades 46 and 53, and the first car door 12*a* and the first landing door 14*a* perform the opening operation together. The second car door 12*b* and the second landing door 14*b* also perform the opening operation in synchrony.

If, on the other hand, the car 8 is in a stopped state outside the door zone due to some abnormality, and a passenger inside the cage 11 attempts to force the car doors 12 open, then because the interlocking rollers 29 and 30 do not contact the doorstop-side blade 46, as shown in FIG. 10, movement of the doorstop-side blade 46 in the door pocket direction is not obstructed. Because of that, when the guiding roller 41 moves to the end portion of the guiding cam 49, the first lower portion link 48 rotates clockwise in FIG. 10, and the locking portion 48*b* displaces to the locked position and catches in the fixed latch 42, preventing movement of the car doors 12 in the opening direction.

In an elevator car door apparatus of this kind, because a door opening preventing function functions only when interlocking rollers 29 and 30 are not present within a vertical range of a doorstop-side blade 46, it is not necessary to separately prepare unlocking cams on landings. Consequently, opening of car doors 12 between floors can be prevented by a simple configuration.

Because a first lower portion link 48 that constitutes a locking member is disposed on a first car door 12*a*, and a fixed latch 42 and a guiding cam 49 are disposed on a second car door 12*b*, relative positions between the first lower portion link 48 and the guiding cam 49 change at twice the door opening speed. Because of that, it becomes possible to design the first and second car doors 12*a* and 12*b* such that dimensions of gaps that are openable by force are reduced.

In addition, because a locking portion 48*b* is formed on the first lower portion link 48 such that the first lower portion link 48 also serves as a locking member, the number of parts can be reduced.

Furthermore, because the locking portion 48*b* and a guiding roller 41 are disposed closer to a doorstop than the doorstop-side blade 46, a position at which the guiding roller 41 contacts the guiding cam 49, and a position at which the locking portion 48*b* catches in the fixed latch 42 can be easily designed.

Embodiment 2

Figure 11:
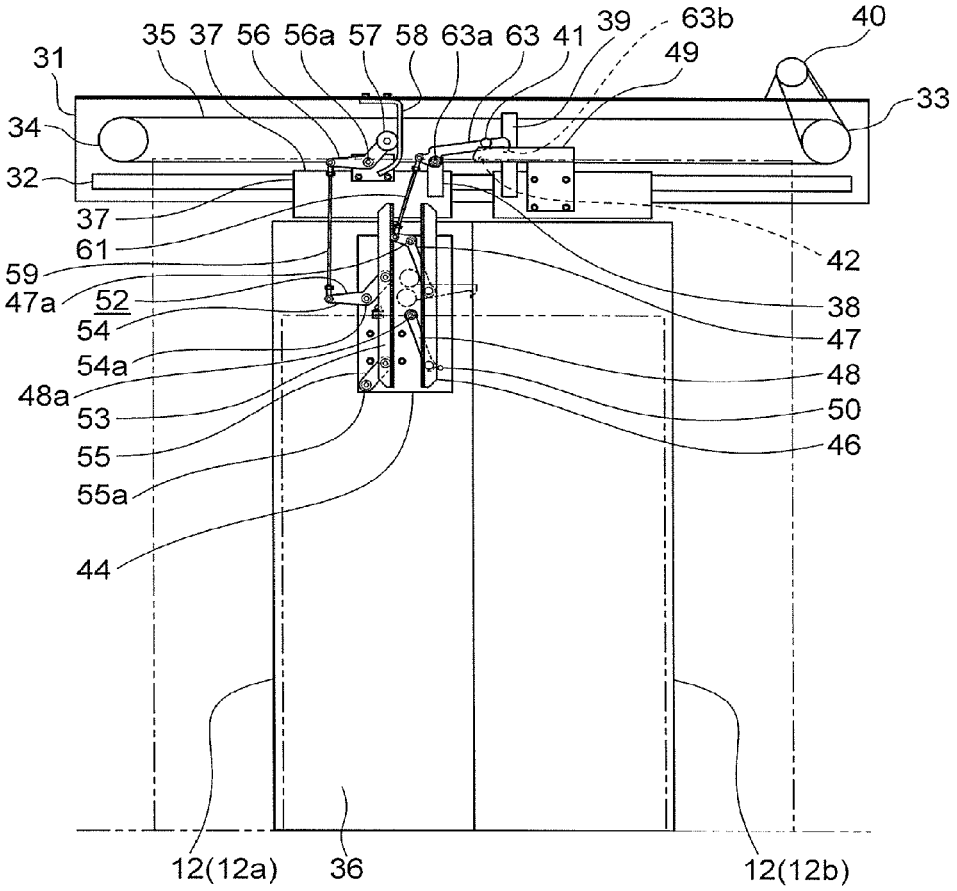
FIG. 11 is a front elevation that shows an elevator car door apparatus according to Embodiment 2 of the present invention.

Next, FIG. 11 is a front elevation that shows an elevator car door apparatus according to Embodiment 2 of the present invention, and corresponds to FIG. 3 in Embodiment 1. In Embodiment 2, a first lower portion link 48 is rod-shaped, and a locking portion 48*b* is not disposed on the first lower portion link 48. A locking lever 63 that functions as a locking member is instead disposed on a first car door linking fitting 38 that is fixed to a car door hanger 37 of a first car door 12*a*.

An intermediate portion of the locking lever 63 is mounted to the first car door linking fitting 38 so as to be rotatable around a rotating shaft 63*a*. A locking portion 63*b* that is similar or identical to the locking portion 48*b* according to Embodiment 1 is formed on a first end portion of the locking lever 63. A guiding roller 41 that is similar or identical to that of Embodiment 1 is also rotatably mounted between the rotating shaft 63*a* and the locking portion 63*b* of the locking lever 63.

A guiding cam 49 that is similar or identical to that of Embodiment 1 is fixed to a car door hanger 37 of a second car door 12*b*. A fixed latch 42 is disposed on the guiding cam 49. When the car doors 12 are in a fully closed state, the guiding roller 41 is positioned on the guiding surface of the guiding cam 49, and the locking portion 48*b* is positioned in the unlocked position that is shown in FIG. 11.

An intermediate portion of the first upper portion link 47 is mounted to the supporting plate 44 so as to be rotatable around a rotating shaft 47*a*. A first end portion (a lower end portion) of the first upper portion link 47 is rotatably linked to the doorstop-side blade 46. A second end portion of the first upper portion link 47 is linked to the second end portion of the locking lever 63 by means of a linking rod 61 that functions as a linking member.

A second end portion of the locking lever 63 is positioned closer to the door pocket side than the rotating shaft 63*a*. A parallel link is configured by the first upper portion link 47, the linking rod 61, and the locking lever 63, such that the first upper portion link 47 and the locking lever 63 constantly maintain an identical angle while rotating. The locking lever 63 is able to displace rotationally between an unlocked position and a locked position interdependently with the movement of the doorstop-side blade 46.

If an attempt is made to open the car doors 12 without imparting an external force to the link 47, the guiding roller 41 is separated from the guiding cam 49, and the locking portion 63*b* moves to the locked position. In this state, the locking portion 63*b* catches on the fixed latch 42, preventing movement of the car doors 12 in the opening direction. The rest of the configuration and operation are similar or identical to those of Embodiment 1.

Using a configuration of this kind, opening of car doors 12 between floors can also be prevented by a simple configuration.

Furthermore, if the ceiling of the cage 11 is high, the car doors 12 may be elongated vertically relative to the car doorway and the car door opening and closing apparatus disposed higher in order to avoid interference with the cage 11. In such cases, the distance between the doorstop-side blade 46 and the car door opening and closing apparatus, which are fixed to constant positions relative to the car doorway, will be further apart, but this can also be accommodated, simply by changing the length of the linking rod 61.

Moreover, in apparatuses of this kind a force of inertia in the doorstop direction arises in the doorstop-side blade 46 due to acceleration in the door opening direction due to the opening operation of the car doors 12. Because this force of inertia works to cancel out the force that the doorstop-side blade 46 exerts in the door pocket direction due to the action of gravity and spring forces, it hinders the locking action of the entire apparatus.

In answer to that, the force of inertia that acts on the doorstop-side blade 46 can be suppressed by configuring the doorstop-side blade 46 using a nonferrous metal that has a specific gravity that is less than that of iron such as an aluminum alloy, for example. Forced opening due to tampering and malfunctions due to mechanical shock (abnormal unlocking operations) can thereby be made less likely to occur.

In the above examples, centrally opening car door apparatuses are shown, but the present invention can also be applied to unidirectionally opening car door apparatuses. In that case, the fixed latch 42 and the guiding cam 49 should be disposed on a portion of the car 8 in a circumference of the car doorway which is outside the blade-carrying car door.

In addition, the type of elevator to which the present invention is applied is not limited to the type in FIG. 1. For example, the present invention can also be applied to machine-room less elevators, to elevators that use two-to-one (2:1) roping methods, to multi-car elevators, or to double-deck elevators.

The invention claimed is:

1. An elevator car door apparatus comprising:

a blade-carrying car door that opens and closes a car doorway by sliding horizontally;

a doorstop-side blade that is disposed on the blade-carrying car door, and that is displaceable horizontally relative to the blade-carrying car door between an unlocking accommodating position, and a locking accommodating position that is closer to a door pocket side than the unlocking accommodating position;

a locking member that is disposed on the blade-carrying car door, and that is displaceable between an unlocked position and a locked position interdependently with movement of the doorstop-side blade;

a fixed latch that is disposed on an external portion of the blade-carrying car door, and that stops movement of the blade-carrying car door in an opening direction by the locking member catching thereon when the locking member is in the locked position;

a guiding cam that is disposed on an external portion of the blade-carrying car door; and a guiding portion that is disposed on the locking member, wherein:

the doorstop-side blade is constantly subjected to a force toward the locking accommodating position;

the locking member is held in the unlocked position, and the doorstop-side blade is also held in the unlocking accommodating position, by the guiding portion contacting the guiding cam when the blade-carrying car door is in a fully closed state;

if the blade-carrying car door moves in the opening direction when a car is positioned in an appropriate floor alignment position, the doorstop-side blade contacts an interlocking roller of an interlocking apparatus that is disposed on a landing door makes contact such that displacement of the doorstop-side blade to the locking accommodating position is prevented, and such that displacement of the locking member to the locked position is also prevented; and when the car is positioned outside the appropriate floor alignment position, the blade-carrying car door moves in the opening direction, the guiding portion moves along the guiding cam, the locking member displaces to the locked position, and the doorstop-side blade also displaces to the locking accommodating position, the locking member catches in the fixed latch, and movement of the blade-carrying car door in the opening direction is prevented.

2. The elevator car door apparatus according to claim 1, further comprising a guiding cam-carrying car door that opens and closes the car doorway by sliding horizontally in an opposite direction to the blade-carrying car door, the fixed latch and the guiding cam being disposed on the guiding cam-carrying car door.

3. The elevator car door apparatus according to claim 2, wherein the doorstop-side blade is constituted by a nonferrous metal that has a specific gravity that is less than that of iron.

4. The elevator car door apparatus according to claim 3, wherein:

the doorstop-side blade is mounted to the blade-carrying car door by means of a plurality of links; and one of the links also serves as the locking member.

5. The elevator car door apparatus according to claim 3, wherein:

the doorstop-side blade is mounted to the blade-carrying car door by means of a plurality of links;

the locking member is disposed above the doorstop-side blade; and one of the links and the locking member are linked by means of a linking member.

6. The elevator car door apparatus according to claim 2, wherein:

the doorstop-side blade is mounted to the blade-carrying car door by means of a plurality of links; and one of the links also serves as the locking member.

7. The elevator car door apparatus according to claim 2, wherein:

the doorstop-side blade is mounted to the blade-carrying car door by means of a plurality of links;

the locking member is disposed above the doorstop-side blade; and one of the links and the locking member are linked by means of a linking member.

8. The elevator car door apparatus according to claim 1, wherein the fixed latch and the guiding cam are disposed on a portion of the car in a circumference of the car doorway.

9. The elevator car door apparatus according to claim 8, wherein the doorstop-side blade is constituted by a nonferrous metal that has a specific gravity that is less than that of iron.

10. The elevator car door apparatus according to claim 9, wherein:

the doorstop-side blade is mounted to the blade-carrying car door by means of a plurality of links; and one of the links also serves as the locking member.

11. The elevator car door apparatus according to claim 9, wherein:

the doorstop-side blade is mounted to the blade-carrying car door by means of a plurality of links;

the locking member is disposed above the doorstop-side blade; and one of the links and the locking member are linked by means of a linking member.

12. The elevator car door apparatus according to claim 8, wherein:

the doorstop-side blade is mounted to the blade-carrying car door by means of a plurality of links; and one of the links also serves as the locking member.

13. The elevator car door apparatus according to claim 8, wherein:

the doorstop-side blade is mounted to the blade-carrying car door by means of a plurality of links;

the locking member is disposed above the doorstop-side blade; and one of the links and the locking member are linked by means of a linking member.

14. The elevator car door apparatus according to claim 1, wherein the doorstop-side blade is constituted by a nonferrous metal that has a specific gravity that is less than that of iron.

15. The elevator car door apparatus according to claim 14, wherein:

the doorstop-side blade is mounted to the blade-carrying car door by means of a plurality of links; and one of the links also serves as the locking member.

16. The elevator car door apparatus according to claim 14, wherein:

the doorstop-side blade is mounted to the blade-carrying car door by means of a plurality of links;

the locking member is disposed above the doorstop-side blade; and one of the links and the locking member are linked by means of a linking member.

17. The elevator car door apparatus according to claim 1, wherein:

the doorstop-side blade is mounted to the blade-carrying car door by means of a plurality of links; and one of the links also serves as the locking member.

18. The elevator car door apparatus according to claim 1, wherein:

the doorstop-side blade is mounted to the blade-carrying car door by means of a plurality of links;

the locking member is disposed above the doorstop-side blade; and one of the links and the locking member are linked by means of a linking member.

* * * * *